US006348010B1

(12) United States Patent
Doolen

(10) Patent No.: US 6,348,010 B1
(45) Date of Patent: Feb. 19, 2002

(54) GOLF CLUB HAVING ANGULAR GROOVES

(76) Inventor: Shaun R. Doolen, P.O. Box 5571, Vail, CO (US) 81658

( * ) Notice: Subject to any disclaimer, the term of this patent is extended or adjusted under 35 U.S.C. 154(b) by 0 days.

(21) Appl. No.: 09/328,984

(22) Filed: Jun. 9, 1999

(51) Int. Cl.[7] ..... A63B 53/00; A63B 53/04
(52) U.S. Cl. ..... 473/290; 473/331; 473/289
(58) Field of Search ..... 473/330, 331, 473/289, 324, 287, 290; D21/733, 750, 751

(56) References Cited

U.S. PATENT DOCUMENTS

| | | | | |
|---|---|---|---|---|
| D55,278 | S | * | 5/1920 | Kraeuter |
| 2,005,401 | A | * | 6/1935 | Storz |
| D96,478 | S | | 8/1935 | Jansky |
| 2,034,936 | A | * | 3/1936 | Barnhart |
| D193,098 | S | * | 6/1962 | Davis |
| D210,033 | S | * | 1/1968 | Johnston |
| 4,252,262 | A | | 2/1981 | Igarashi |
| 4,792,140 | A | * | 12/1988 | Yamaguchi |
| D346,840 | S | * | 5/1994 | Fenton |
| 5,354,059 | A | * | 10/1994 | Stuff |
| 5,688,186 | A | * | 11/1997 | Michaels |
| 5,690,531 | A | | 11/1997 | Rowland et al. |
| 5,785,610 | A | * | 7/1998 | Birmingham |

FOREIGN PATENT DOCUMENTS

| | | | |
|---|---|---|---|
| JP | 2005980 A2 | | 1/1990 |
| JP | 9-131421 | * | 5/1997 |
| JP | 9299518 A2 | | 11/1997 |

OTHER PUBLICATIONS

International Search Report, PCT/US 00/15712

* cited by examiner

*Primary Examiner*—Sebastiano Passaniti
(74) *Attorney, Agent, or Firm*—Swanson & Bratschun LLC

(57) ABSTRACT

A golf club has grooves across its face that are angled from an upper face section positioned relatively toward a toe of the club to a lower face section positioned relatively toward the heel with respect to the sole of the golf club instead of being parallel with a sole of the club. The angled grooves cause a sideways spin to be imparted to a struck golf ball. In one application, the angled grooves impart a spin that corrects for what would otherwise be a slice. The grooves can be at different angles, depending upon the golf club and the application. In an embodiment, the low irons and woods will have the grooves at a relatively higher angle than the mid irons, which will have the grooves at a higher angle than the approach irons and wedges. Clubs having such angled grooves can be structured according to USGA or other rules, but need not be.

19 Claims, 6 Drawing Sheets

GOLF CLUB HAVING ANGULAR GROOVES

FIELD OF THE INVENTION

The present invention relates to the field of golf, and more particularly to golf clubs that impart corrective spin on a golf ball to impart desired flight characteristics.

BACKGROUND

The sport of golf has a long history and is enjoyed by many participants throughout the United States and the world. The sport is well known and need not be described in detail except as is necessary to describe the present invention. Briefly, a player strikes a golf ball with a golf club. The golf club includes a shaft gripped by the player ("golfer"), to which is attached a golf club head which strikes the ball. The portion of the head that strikes the ball is called the "face," which is a generally planar surface. The bottom perimeter of the golf club face (as defined when the club is used in its intended manner to strike the ball) is called the "sole." It is noted here that the golf clubs relevant to the present invention are all "distance" clubs, as opposed to "putters," which are used in a substantially different manner from distance clubs and which are not relevant to the present invention.

A phenomenon all too familiar to most recreational golfers and even professional golfers is the "slice," which is a description of the path of a golf ball that moves in an increasing curve away from a golfer in the direction the golfer is facing. While it is in some cases be desirable to slice the ball, a slice is much more commonly the result of flaws in the golfer's swing. Slicing the ball misdirects the ball from its intended trajectory, which can frustrate the golfer and prevent the golfer from obtaining a satisfactory score.

A slice is caused by a horizontally glancing blow of the club, which imparts spin. Such a glancing blow is influenced by the club face angle and by the swing path at the moment of impact. To avoid a slice, the face angle and the swing path should be at right angles at the absolute point of impact. However, because the club head carries the ball somewhat during and immediately after impact, there is a high likelihood of imparting a slicing horizontal spin.

A related phenomenon is the "hook," which is a description of the path of a golf ball that moves in a curve away from the direction the golfer is facing. Because of the swing path of a typical golfer, hooking is much less common than slicing. Like the slice, the hook is sometimes intended but it more often unintended, and can also prevent a golfer from achieving a good score. However, the difficulty of hooking the ball and its perceived aesthetics are such that sometimes a golfer will attempt to hook the ball, in a shot called a "draw." The ability to make a draw show is often a source of accomplishment to the golfer.

In addition to a horizontal spin that would cause a slice or hook, a struck golf ball generally also has a backspin, which is the spinning of the ball in a clockwise manner in relation to the vertical axis of the golfer, from the golfer's perspective. The spinning ball rises because of the Magnus Effect (as described in more detail herein), thus affecting the trajectory. More backspin results in a higher trajectory. Additionally, backspin aids in the ability to stop the ball on the green without excess roll.

A number of different golf clubs are used by a golfer depending upon the position of the ball on the course and its distance to the hole. Typical golf clubs are a set of "woods," a set of "irons" in the range of 1–9, and several of wedges. The difference between the clubs (within a class of clubs) are the "loft" of the golf head, which is the angle between the club head face and the axis of the shaft, and the length of the shaft. The higher lofted clubs typically have shorter shafts; the combination of high loft and a short shaft results in greater backspin.

A consequence of the longer shaft lengths of the lower lofted clubs is increased head speed. This is because such a club is swung in an arc of greater radius than a shorter club. The increased head spin increases the horizontal spin and exaggerates a slice (or a hook).

Presently, all commercially available clubs known to the inventor have grooves in the club face that are parallel to the club face sole. Such grooves increase the friction between the club face and the ball and therefore increase the spin imparted to the ball. While such grooves are useful for increasing backspin, they do not assist in imparting a desired horizontal spin that could correct for a hook or slice.

U.S. Pat. No. 5,785,610 of Birmingham (1998) describes a golf club having grooves in a what is a described as a "chevron" pattern. The chevron pattern grooves may serve to impart horizontal spin to the ball. However, the chevron pattern is not believed to be useful because it assumes that horizontal spin that is imparted on the ball is solely a function of the portion of the club face that the impacts the ball. It therefore has grooves of different angular slopes across the club face. It is believed that the chevron pattern is not effective in reducing slice, and further, even if grooves of different slope across the club face are used, the slopes should not be as shown in the Birmingham patent.

An understanding of the principles behind the present invention requires an understanding of the "Magnus Effect." This well understood effect is a particular manifestation of Bernoulli's theorem that fluid pressure decreases as fluid speed increases. This effect explains the "curve" of rotating balls such as baseballs and golf balls. Pressure differences develop in a fluid through which a spinning sphere moves. Greater pressure on the side where the airflow is slowed down forces the ball in the direction of the low-pressure region on the opposite side, where there is a relative increase in airflow.

Finally, it should be noted that while the principles on which the present invention is based are believed to be well understood, the effectiveness of the present invention has been verified through experiment and therefore the scope the invention should not be limited by the validity of any scientific theory.

SUMMARY

The present invention includes a golf club head having a golf club face with a plurality of grooves angled across the face at an angle that is substantially non-parallel with the club sole, the grooves being sloped in the same direction as one another. The purpose of the grooves is to impart a corrective spin on a struck golf ball. The angle of the grooves is preferably varied depending upon the loft angle of the club. An advantage of the present invention is that slicing is eliminated or greatly reduced, and a golfer can much more easily draw the ball if desired.

DETAILED DESCRIPTION

The present invention includes golf clubs having grooves that are angled across the club face with respect to the sole of the club. Currently used clubs have parallel grooves with respect the sole of the club, which is defined to be an angle of zero degrees herein.

Representative groove angles are shown in FIGS. 1A–1H, with reference to the table 5 below.

TABLE

| FIGURE | CLUB | LOFT ANGLE (°) | GROOVE ANGLE (°) |
|---|---|---|---|
| 1B | 1 Iron | 17 | 45 |
| 1C | 2 Iron | 20 | 45 |
| 1D | 3 Iron | 24 | 45 |
| 1E | 4 Iron | 28 | 45 |
| 1F | 5 Iron | 32 | 40 |
| 1G | 6 Iron | 36 | 35 |
| 1H | 7 Iron | 40 | 30 |
| 1I | 8 Iron | 44 | 25 |
| 1J | 9 Iron | 48 | 20 |
| 1K | P | 52 | 10 |
| Not Shown | A | 54 | 10 |
| Not Shown | S | 56 | 10 |
| 1L | L | 60 | −20 |
| 1A | Woods | 6–32 | 45 |

Figure 1A:
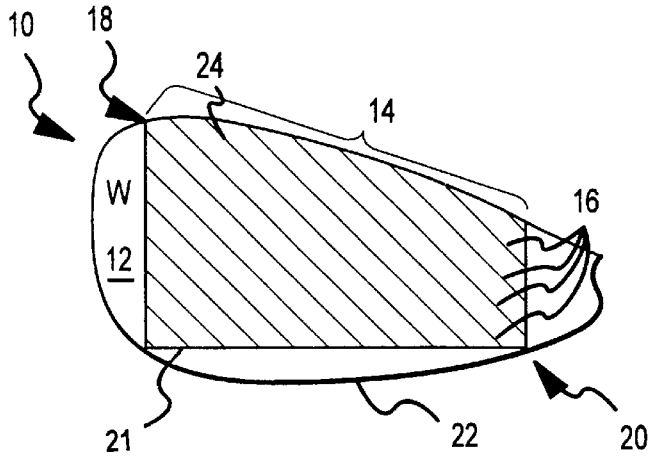
FIGS. 1A–1L are elevation views of the faces of a set of golf clubs according to an embodiment of the present invention.
Figure 1B:
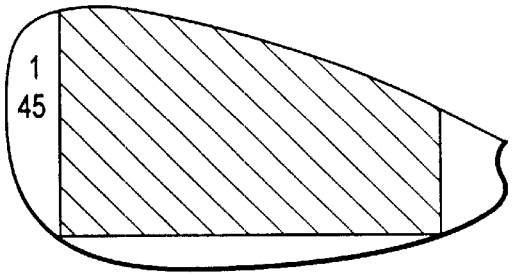
Figure 1C:
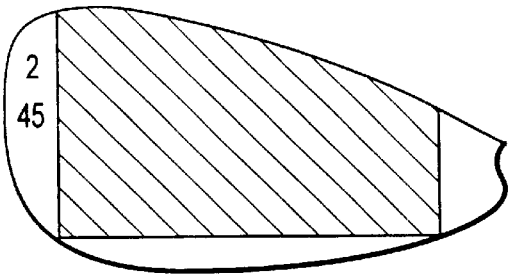
Figure 1D:
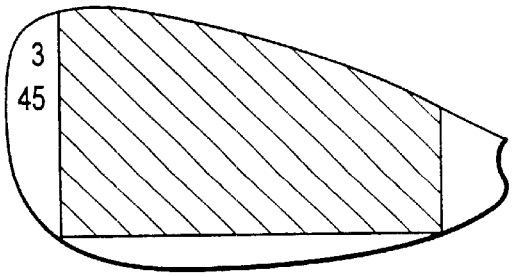
Figure 1E:
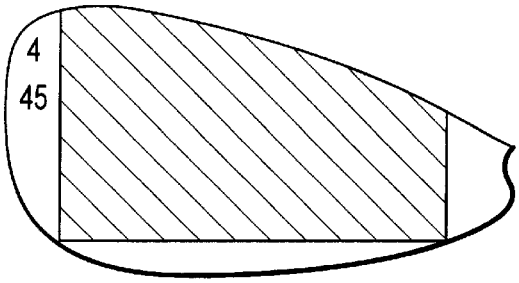
Figure 1F:
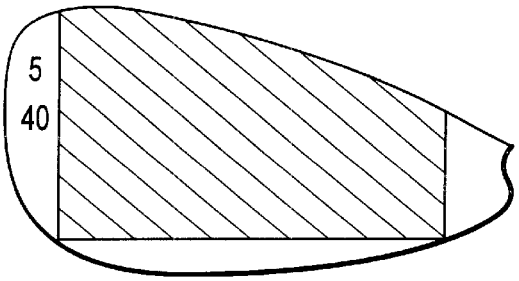
Figure 1G:
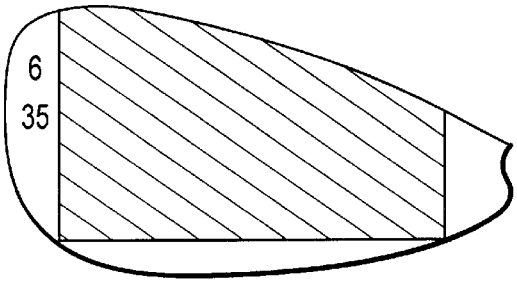
Figure 1H:
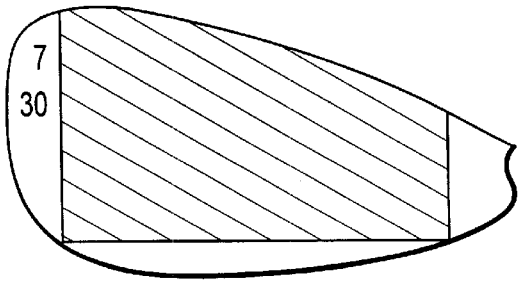
Figure 1I:
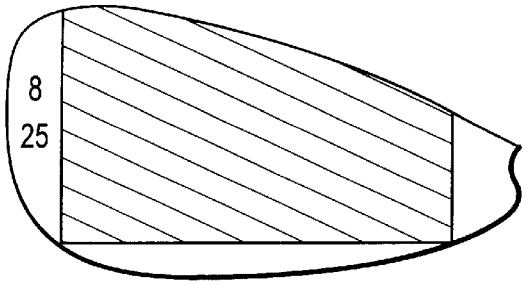
Figure 1J:
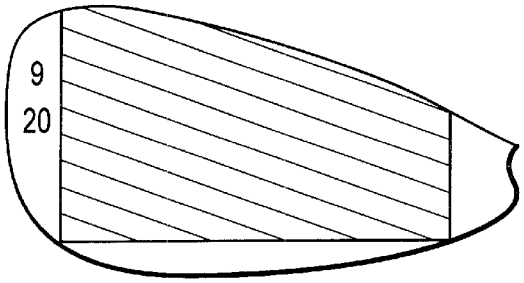
Figure 1K:
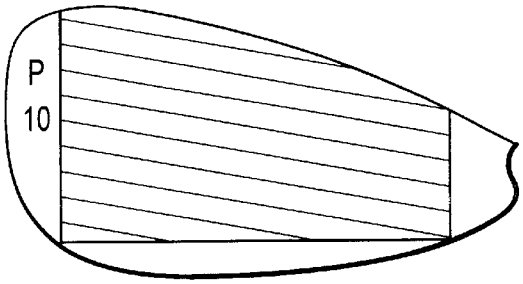
Figure 1L:
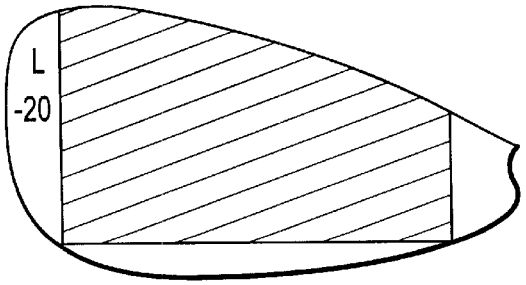

With reference to FIG. 1A, a club 10 having a face 12 with an intended impact area 14 is shown. The intended impact area 14 is the primary portion of the face 12 that would normally strike a golf ball, and may be relatively larger or smaller than shown. A plurality of grooves 16 traverse the impact area. In FIG. 1A, the grooves angle from an upper toe section 18 toward a lower heel section 20 at a 45 degree angle. In FIGS. 1–1L, a number of additional clubs are shown having grooves of different angles, as can be determined with reference to the TABLE. For the loft wedge of FIG. 1L, a negative slope (meaning the lines angle in the opposite direction) is shown.

Figure 2:
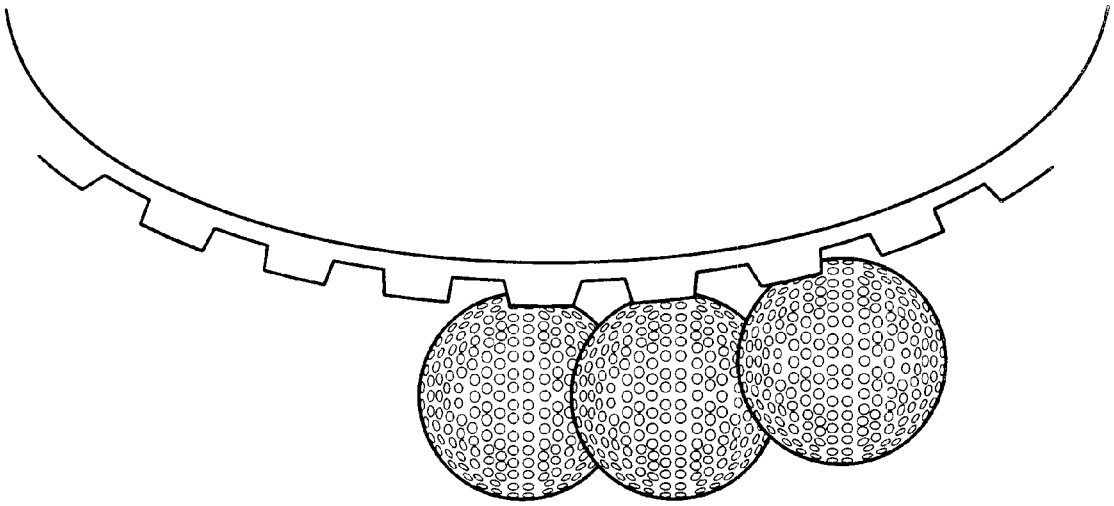
FIG. 2 is a schematic view illustrating the gear effect according to an embodiment of the present invention.
Figure 3:
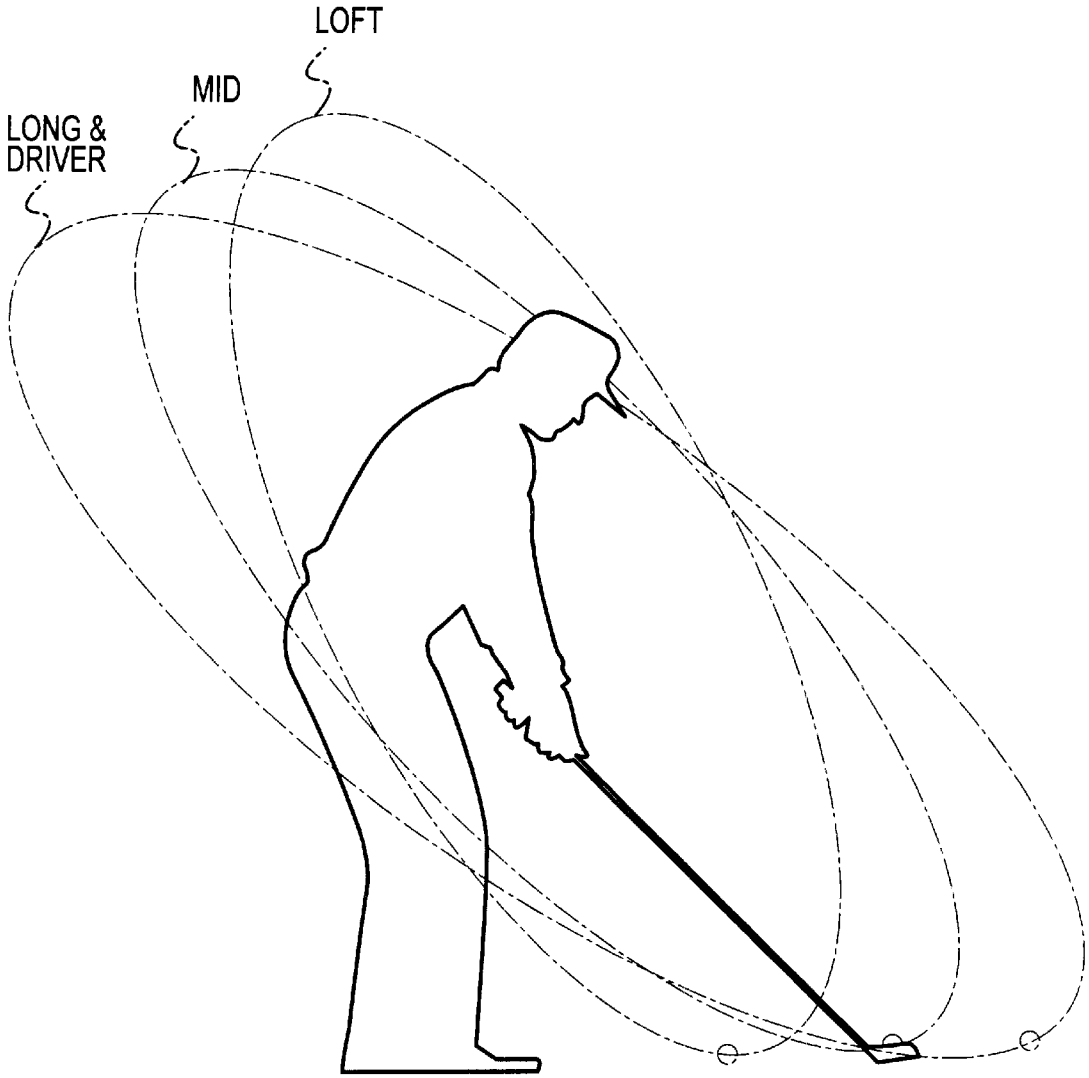
FIG. 3 is a perspective view of a golfer illustrating different swing arcs for different club heads.
Figure 4:
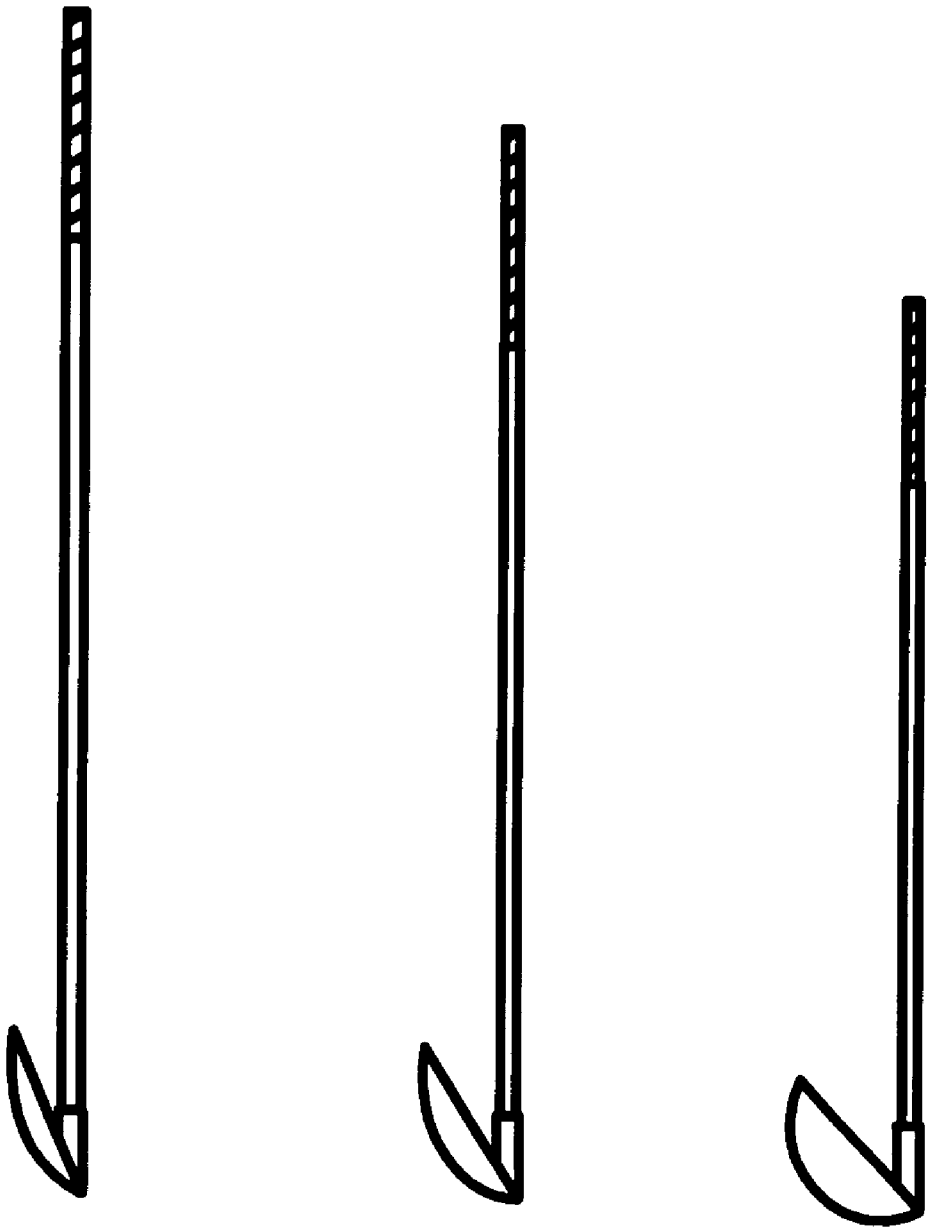
FIG. 4 is an elevational view depicting decreasing shaft length as the loft angle of club heads increases.

The angular groove design imparts a corrective horizontal spin to the ball, while still providing for the availability of backspin. With reference to the schematic diagram of FIG. 2, the angled grooves induce a gear effect as the club impacts the ball. The ball is depressed into the grooves creating a meshing of the grooves with the contacting portion of the ball. As the club carries the ball forward, this gear effect causes an angular spin which counteracts the golfer's slice. The higher degree of groove angle with the lower irons and woods is generally desirable because the club head speed is faster and greater corrective spin must be induced (the difference is swing path between clubs is shown in FIG. 3). The mid irons (#4–6) require a less steep groove angle because the swing place is steeper and the clubhead speed is less. The approach irons and wedges are the shortest length clubs and have the steepest swing plane of the clubs. Therefore, the groove angle may be the least, thus providing relatively more backspin and less corrective horizontal spin.

The angled grooves 16 run across the impact area 14 of the of the club face from the sole 22 to the top edge 24 of the face 12. The angled grooves 16 are parallel with one another. It can be appreciated that the grooves can traverse the entirety of the club face 10, or a smaller portion of the club face that corresponds to the impact area.

In one embodiment of the invention, the grooves are structured to conform to the United States Golf Association rules, the contents of which are incorporated by reference. Briefly summarizing the rules as they currently stand, any rounding of the groove edges shall be in the form of a radius which does not exceed 0.020 inches (0.5 mm); the groove width shall not exceed 0.035 inches (0.9 mm) using the thirty degree measurement method; the distance between edges of adjacent grooves must not be less than three times the width of a groove, and not less than 0.075 inches (1.9 mm); and the depth of the grooves must not exceed 0.020 inches (0.5 mm). It will be readily understood that these rules may be changed over time, and thus the structure of a club according to this embodiment could be correspondingly changed. While the above parameters describe the maximum size and density of grooves, a club according this embodiment could have smaller and/or less dense grooves. The grooves may have any allowable shape, such as what are known as "U" shaped grooves or "V" shaped grooves. Of course, the standards of any other golfing organization besides the USGA could also be adopted, so long as such rules do not prohibit grooves that are angled with respect to the sole of the club.

In another embodiment of the invention, the grooves may be structured so that they do not conform to the United States Golf Association rules. In such an embodiment, the grooves could have any shape, size, and density.

It should be appreciated that groove angles listed in the above table are merely illustrative embodiments of the invention and are not intended to limit the scope of the invention, except as to a specific embodiment. The precise angles are not necessarily critical and deviations should also produce acceptable results. To the contrary, it is contemplated that a club of a given loft might be manufactured in a number of different versions of differing groove angles, because the amount of corrective spin that is desirably imparted on the ball depends to some extent upon the swing of an individual golfer. The deviations from the parameters listed in the table may be minor, such as several degrees, or major. In an example of a major change, the groove angles may be sloped in the opposite direction (at any angle) from that shown in FIG. 1, which would be useful for golfers who have an unusual tendency to hook the ball. It will also be apparent that the depicted clubs are "right-handed," and that the invention has equal applicability to "left-handed" clubs.

It will also be appreciated that a club could be constructed according to the present invention but could have a different appearance from these shown in FIGS. 1A–1L. For example, the grooves 16 could be replaced with grooves that are not continues. Grooves could be used that would have some degree of curvature (i.e., are not straight line segments). Or, a plurality of grooves could be used that are not identical to one another in some respects. None of these variations (or other variations that may be apparent to those skilled in the art) should necessarily be deemed to place such a club outside of the scope of the present invention. The above described invention provides means of a club face to achieve a corrective horizontal spin to a golf ball, and other equivalent means may fall within the inventive scope.

I claim:

1. A set of golf clubs comprising:

at least two golf clubs belonging to the set of iron-type or wood-type golf clubs, each club comprising a shaft and a club head, each club head having a heel attached to one end of the shaft, a toe opposite the heel and a sole defining the bottom of the club head extending between the heel and the toe, the club head further including a ball-striking face with an intended impact area covering part of the face and extending continuously across the face from near the heel to near the toe, the intended impact area having a plurality of grooves therein, each groove extending at a groove angle relative to the sole, each club head further having a loft angle, wherein between two consecutive varying loft angle club heads at least one of said consecutive varying loft angle golf club heads has a groove angle of more than 15 degrees and as between said two consecutive varying loft angle golf club heads the groove angle increases as the varying loft angle decreases.

2. The set of golf clubs of claim 1 wherein the grooves extend in parallel continuously from an upper face section positioned relatively toward the toe to a lower face section positioned relative toward the heel.

3. The set of golf clubs of claim 1 wherein each club head is an iron and the groove angle varies with the loft angle as follows:

| LOFT ANGLE (°) | GROOVE ANGLE (°) |
|---|---|
| 17 | 45 |
| 20 | 45 |
| 24 | 45 |
| 28 | 45 |
| 32 | 40 |
| 36 | 35 |
| 40 | 30 |
| 44 | 25 |
| 48 | 20 |
| 52 | 10 |
| 54 | 10 |
| 56 | 10 |
| 60 | −20 |

4. The set of golf clubs of claim 1 wherein each club head is a wood and at least one club head has a groove angle of about 45 degrees.

5. The set of golf clubs of claim 1 wherein each shaft has a length and the length is a function of the loft angle.

6. The set of golf clubs of claim 5 where the shaft length decreases as the loft angle increases.

7. The set of golf clubs of claim 1 wherein for clubs having a loft angle of less than 56 degrees, the grooves extend in parallel continuously from an upper face section positioned relatively toward the toe to a lower face section positioned relatively toward the heel, and for clubs having a club head that is an iron and a loft angle of 60 degrees or greater, the grooves extend in parallel continuously from a lower face section positioned relatively toward the toe to an upper face section positioned relatively toward the heel.

8. The set of golf clubs of claim 7 wherein for clubs having a club head that is an iron and a loft angle of about 60 degrees or greater, the groove angle is about 20 degrees.

9. The set of golf clubs of claim 1 wherein for club heads that have a loft angle of less than about 56 degrees, the groove angle is between about 10–45 degrees.

10. A set of golf clubs comprising;

a plurality of golf clubs belonging to the set of iron-type or wood-type golf clubs, each club comprising a shaft and a club head, each club head having a heel attached to one end of the shaft, a toe opposite the heel and a sole defining the bottom of the club head extending between the heel and the toe, the club head further including a ball-striking face with an intended impact area covering part of the face and extending continuously across the face from near the heel to near the toe, the intended impact area having a plurality of grooves therein, the face further including reference indicia parallel to the sole, each groove extending at a groove angle relative to the referemce indicia, each club head further having a select loft angle, the groove angle between two consecutive varying loft angle club heads being a function of the select loft angle, and at least one of said consecutive loft angle club heads having a groove angle of more than 15 degrees.

11. The set of golf clubs of claim 10 wherein the grooves extend in parallel continuously from an upper face section positioned relatively toward the toe to a lower face section positioned relative toward the heel.

12. The set of golf clubs of claim 10 wherein as between golf club heads the groove angle increases as the loft angle decreases.

13. The set of golf clubs of claim 10 wherein each club head is a wood and each groove angle is about 45 degrees.

14. The set of golf clubs of claim 10 wherein each shaft has a length and the length is a function of the loft angle.

15. The set of golf clubs of claim 14 where the shaft length decreases as the loft angle increases.

16. The set of golf clubs of claim 10 wherein for clubs having a loft angle of less than 56 degrees, the grooves extend in parallel continuously from an upper face section positioned relatively toward the toe to a lower face section positioned relatively toward the heel, and for clubs having a club head that is an iron and a loft angle of object 60 degrees or greater, the grooves extend in parallel continuously from a lower face section positioned relatively toward the toe to an upper face section positioned relatively toward the heel.

17. The set of golf clubs of claim 16 wherein for clubs having a club head that is an iron and a loft angle of about 60 degrees or greater, the groove angle is about 20 degrees.

18. The set of golf clubs of claim 10 wherein for club heads that have a loft angle of less than about 56 degrees, the groove angle is between about 10–45 degrees.

19. The set of golf clubs of claim 18 wherein as between golf club heads the groove angle increases as the loft angle decreases.

* * * * *